United States Patent [19]

Nagashima

[11] 4,405,262

[45] Sep. 20, 1983

[54] METHOD FOR ERECTION OF A TEMPORARY BRIDGE, AND A PILE MEANS THEREFOR

[76] Inventor: Masaya Nagashima, 4-6, Takayanagi 3-chome, City of Kisarazu, Chiba Prefecture, Japan

[21] Appl. No.: 192,691

[22] Filed: Oct. 1, 1980

[30] Foreign Application Priority Data

Jan. 8, 1980 [JP] Japan ..... 55-663

[51] Int. Cl.[3] ..... E02D 5/56

[52] U.S. Cl. ..... 405/221; 52/126.1; 248/356; 405/229; 405/231

[58] Field of Search ..... 405/229, 230, 231, 236, 405/235, 238, 240, 248, 256, 219, 221, 269, 233; 248/356, 161; 52/126

[56] References Cited

U.S. PATENT DOCUMENTS

| | | | |
|---|---|---|---|
| 985,921 | 3/1911 | Mounier | 248/356 X |
| 1,368,896 | 2/1921 | Chambley | 405/254 X |
| 2,687,619 | 8/1954 | Newell | 405/221 |
| 3,382,627 | 5/1968 | Yartia | 52/126 |
| 3,830,468 | 8/1974 | Whitchurch et al. | 248/356 X |
| 3,842,608 | 10/1974 | Turzillo | 405/239 X |
| 3,962,879 | 6/1976 | Turzillo | 405/236 |
| 4,027,491 | 6/1977 | Turzillo | 405/235 |

FOREIGN PATENT DOCUMENTS

| | | | |
|---|---|---|---|
| 65615 | 7/1914 | Austria | 405/241 |
| 622354 | 12/1962 | Belgium | 52/126 |
| 826811 | 1/1952 | Fed. Rep. of Germany | 248/356 |
| 2811136 | 9/1979 | Fed. Rep. of Germany | 52/126 |
| 582315 | 12/1954 | France | 405/256 |
| 1316824 | 12/1962 | France | 248/356 |
| 50-144205 | 11/1975 | Japan . | |
| 50-144206 | 11/1975 | Japan . | |
| 51-18105 | 2/1976 | Japan . | |
| 552833 | 4/1943 | United Kingdom | 248/356 |

*Primary Examiner*—Dennis L. Taylor

*Attorney, Agent, or Firm*—Amster, Rothstein & Engelberg

[57] ABSTRACT

A method for the erection of a temporary bridge, etc. and a pile means to be used for carrying out the same are disclosed which are characterized in that a pile member as one of the pile means having a metalic pipe form with an open upper end and a closed lower end is rotated by a prime mover for an earth-auger, mounted to its upper end and hung from the boom of a mobile crane, to be rotated, whereby the pile member is driven into the ground by the action of a spiral propelling element formed around its outer periphery, the pile member, after reaching a desired depth, being then rotated in reverse while it is prevented from being moved upwards so that the soil around it is forced radially to be tightly compressed by the action of the spiral propelling element, and a height adjusting member as one of the pile means is introduced into the pile member from its upper open end till the bottom of the height adjusting member abuts the partition plate previously secured to the inside of the pile member at its upper portion, thereafter sand, etc. is supplied into the height adjusting member, whereby, when it is lifted bit by bit the sand flows through an orifice previously formed in the bottom to fill the space formed between it and the partition plate of the pile member to adjust the height of the height adjusting member relative to the pile member. After a predetermined number of the pile members together with the height adjusting members have been thus driven into the ground, bridge girders, cover plates, etc. are mounted on the height adjusting members to erect a temporary bridge, etc.

4 Claims, 10 Drawing Figures

METHOD FOR ERECTION OF A TEMPORARY BRIDGE, AND A PILE MEANS THEREFOR

BACKGROUND OF THE INVENTION

The present invention relates to a method for the erection of a temporary bridge, or landing pier, or the like and more particularly to a method for the erection of the same using pile means adapted to be rotated. The present invention also relates to pile means for carrying out the method.

Hitherto, in the case of the erection of a temporary bridge, landing pier, or the like, it has been the usual practice to drive H-beams made of steel into the ground using e.g. a pile driving machine so that the H-beams thus driven into the ground are utilized as piles, bridge piers, etc. However, such erection work causes vibration as well as noise during the work, resulting in the creation of a serious pollution problem, etc. and when the ground is soft, since its bearing power for the H-beams is low, it may often be the case that e.g. the bridge piers of the temporary bridge settle while the bridge is in use. Moreover, in the erection work, since the materials including the H-beams have to be cut, welded, etc. at the working site, many problems in terms of the working performance, working safety, etc. have been involved.

SUMMARY OF THE INVENTION

It is a primary object of the present invention to provide a method for the erection of temporary bridges, etc. which can do away with the defects in the conventional method as abovementioned.

It is another object of the present invention to provide a method for the erection of temporary bridges, etc. which can remarkably improve the working efficiency of the erection.

It is a further object of the present invention to provide a method for the erection of temporary bridges, etc. which can give the bridge piers, etc. large bearing power not only in the horizontal direction, but also in the vertical direction even in the case of soft ground.

It is still another object of the present invention to provide a method for the erection of temporary bridges, etc. which allows work without noise, vibration, etc.

It is a still further object of the present invention to provide a pile means which is useful for carrying out the method according to the present invention.

In accordance with the present invention as a method for the erection of temporary bridges, etc. is provided which comprises the steps of revolving a hollow rigid pipe, opened and closed at its upper and lower ends, respectively, having a definite length and having its outer periphery provided with an appropriate means to force the pipe to be propelled into the ground when revolved, stopping the revolution when the pipe reaches a predetermined depth, tightly compressing the soil around the pipe by revolving it in reverse while maintaining it at a substantially constant position, stopping the reverse revolution of the pipe, introducing into the pipe from above through its upper opened end a height adjusting member having a bottom with a sand discharge orifice being formed therethrough till its lower end reaches a partition plate previously provided within the pipe at its upper portion, pouring sand, etc. into the height adjusting member, adjusting the height of the height adjusting member relative to the pipe by raising the height adjusting member bit by bit so that a quantity of the sand, etc. necessary to fix the height of the height adjusting member flows through the discharge orifice to fill the gap formed between the bottom of the height adjusting member and the partition plate of the pipe, repeating the above procedure till a desired number of the pipes together with the height adjusting members are driven into the ground, and finally mounting on the height adjusting members one or more bridge girders, etc. and further cover plates thereon, if required.

Among the above steps, the step of tightly compressing the soil can take place while sand, crushed stone, or the like is supplied around the pipe from above with the object of carrying out the compression more effectively.

Further, the step of tightly compressing the soil may be omitted if the ground condition is good, e.g. it is not too soft.

The method according to the present invention as above described can be advantageously practiced when the driving in of the pipes is carried out such that they are revolved by a prime mover for driving an earth-auger, adapted to be successively connected to the upper ends of the pipes, hung from the boom of a wheel crane, crawler crane, truck crane, or the like (hereinafter referred to as "a mobile crane") and the erection of the bridge girders and cover boards are also effected by the same mobile crane subsequent to the driving in of the pipes.

According to the other aspect of the present invention, a pile means particularly suitable for carrying out the method in accordance with the present invention is provided which comprises a pile member and a height adjusting member, said pile member comprising a hollow cylindrical pile body having a predetermined length, made of metal, preferably steel, with its upper and lower ends being opened and closed, respectively, a spiral propelling element protrudingly provided on the outer periphery of the pile body over substantially its entire length, and a partition plate provided within the hollow pile body at its upper portion, and said height adjusting member comprising a hollow cylindrical body having an outer diameter somewhat smaller than the inner diameter of the cylindrical pile body and a length somewhat longer than the depth of the pile body above its partition plate, the hollow cylindrical body being provided at its upper end with a base plate having a sand supply orifice formed therethrough and at its lower end with a bottom having a sand discharge orifice formed therethrough, whereby the sand discharge orifice may be provided with a valve means so as to close the orifice, if required.

BRIEF DESCRIPTION OF THE DRAWINGS

The above and other objects of the present invention will be more fully understood by reference to the following detailed description of the presently preferred, but nonetheless illustrative embodiments, in accordance with the present invention, when taken in conjunction with the accompanying drawings, wherein.

DESCRIPTION OF THE PREFERRED EMBODIMENTS

Figure 1:
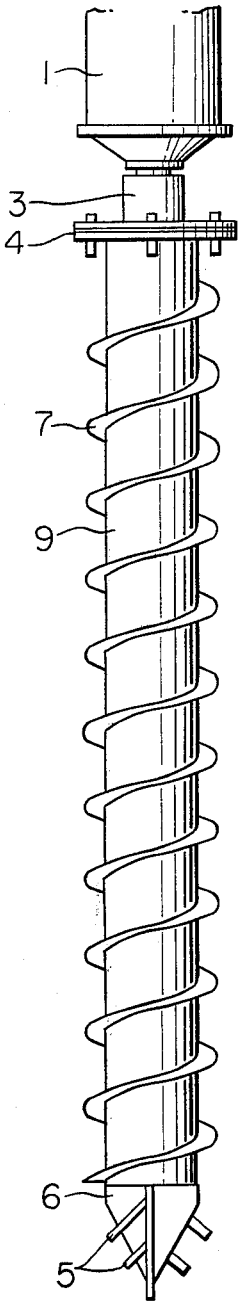
FIG. 1 is a side elevational view of one embodiment of a pile member according to the present invention with a prime mover for driving an earth-auger being secured to the upper end of the pile.
Figure 2:
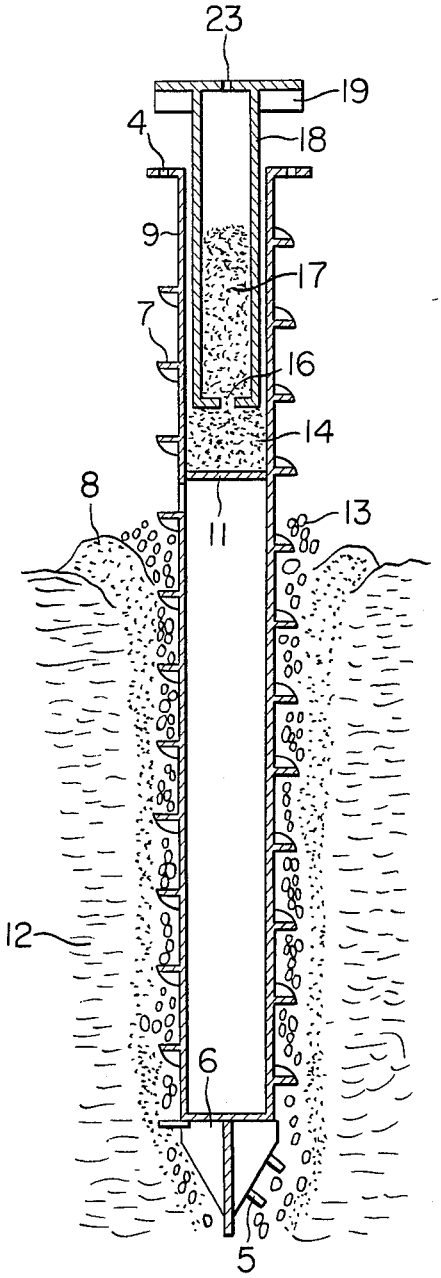
FIG. 2 is a longitudinal sectional view of the pile member shown in FIG. 1 in the state driven into the ground with a height adjusting member being introduced into the upper portion of the pile member.

Referring now to FIG. 1 of the attached drawings wherein is shown one embodiment of pile member 9 of a pile means according to the present invention together with a prime mover 1 for driving an earth-auger as mounted to pile member 9. As shown in FIGS. 1 and 2 pile member 9 comprises a pipe-like body made of metal, preferably steel, having a definite length with the upper and lower ends being opened and closed, respectively. A flange 4 is fixedly secured to the upper end of hollow pile member 9 adapted to mount it to prime mover 1 through a connector 3 having any desired design suitable for establishing operational connection therebetween. The body of pile member 9 is further provided on its outer periphery over substantially its entire length with a propelling element 7 which is realized in the embodiment shown as a spiral blade protruded outward. Further, provided on the bottom of pile member 9 are tip blades 5, 6 having a generally conical configuration with the apex directed downwards. Fixedly secured to the inner wall of hollow pile member 9 is a partition plate 11 at a suitable lower position from the upper end so as to form a height adjusting chamber 14 to adjust the height of a bridge pier, etc. in association with a height adjusting member 18 to be described fully later.

FIG. 2 shows pile member 9, in section, in the state of being driven into the ground with height adjusting member 18 being introduced within height adjusting chamber 14 of pile member 9. As can be seen from FIG. 2 height adjusting member 18 has the form of a cylinder with an outer diameter somewhat smaller than the inner diameter of hollow pile member 9 and a height somewhat higher than the depth of height adjusting chamber 14. Further, the upper end of height adjusting member 18 is closed by a rectangular base plate 19, formed centrally thereof with a sand supply orifice 23, and the lower end is closed by a bottom plate, formed centrally thereof with a sand discharge orifice 16, sand discharge orifice 16 being capable of being additionally provided with a valve means 15 as more fully explained later in reference to FIGS. 6 to 8. Further, in FIG. 2, 8 shows sediment discharged as the result of the rotation of pile member 9 due to the excavating action of spiral propelling blade 7 of pile member 9 and 13 a consolidation material used for tightly compressing ground 12.

Figure 3:
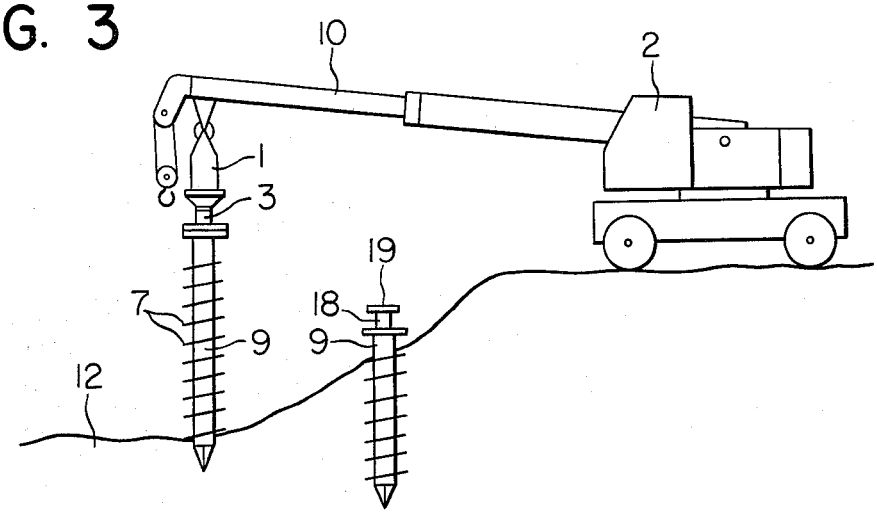
FIGS. 3 to 5 are schematical views showing the steps of erection of e.g. a temporary bridge using the pile means shown in FIGS. 1 and 2, in association with a mobile crane, and applying the method according to the present invention.
Figure 5:
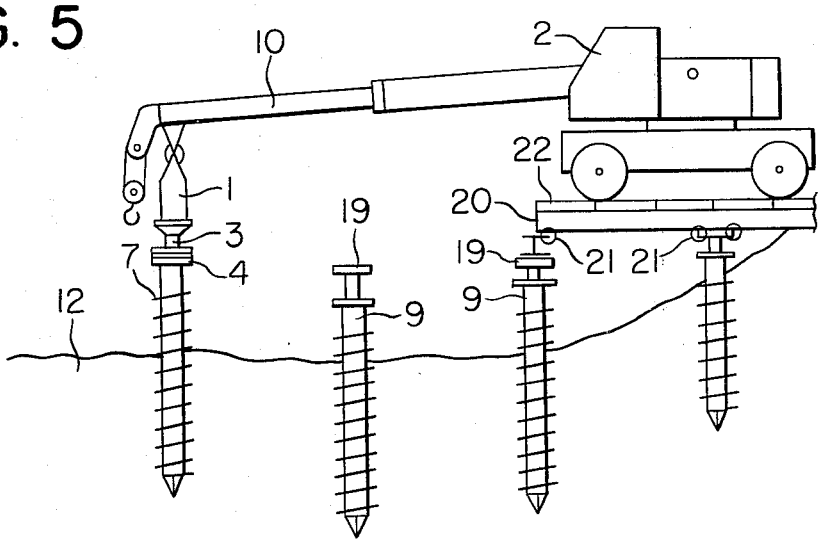
Figure 4:
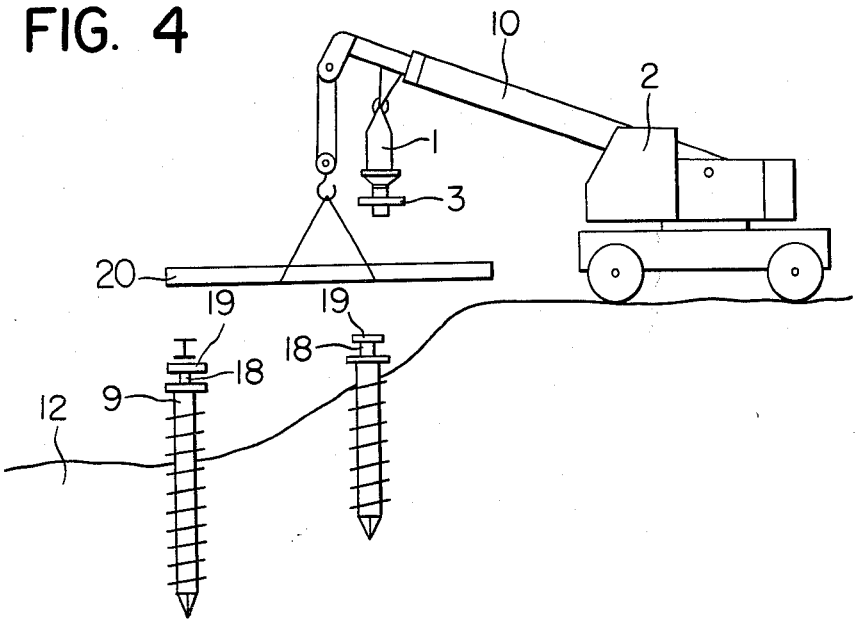

FIGS. 3 to 5 show the process whereby, by applying the method according to the present invention and using pile means according to the present invention, comprising pile members 9 and height adjusting members 18 as shown in FIGS. 1 and 2, e.g. a temporary bridge is erected in cooperation with a mobile crane 2.

Firstly, as shown in FIG. 3 pile member 9 provided with spiral propelling element 7 as shown in FIG. 1 is secured to prime mover 1 for driving an earth-auger, suspended from the forward end of the boom of mobile crane 2, through connector 3 by means of flange 4, and it is subsequently rotated by prime mover 1. Then, pile member 9 is driven into ground 12, discharging soil or sediment 8 upwards by means of tip blades 5, 6 provided on the lower end as well as spiral propelling blade 7 provided on the outer periphery of hollow pile member 9 as shown in FIG. 2. Upon reaching a predetermined depth, prime mover 1 is stopped, and is then rotated in reverse with pile member 9 continuing to be urged downwards under the compression of boom 10 of mobile crane 2. In this case, since pile member 9 is also rotated in reverse, spiral propelling blade 7 of pile member 9 operates to force sediment or soil 8 downwards so that soil or sediment 8 as well as consolidation material 13 supplied from above are thrust outwards around pile member 9 to be compressed tightly, whereby pile member 9 begins to move upwards. When this occurs, the rotation of prime mover 1 is stopped, connector 3 is separated from flange 4, and the driving-in operation of pile member 9 is finished.

Thus, a desired number of pile members 9 are sequentially driven into ground 12 in the same manner. In this case, when ground 12 is soft or the bearing stratum is deep, ground 12 can be compressed tightly to a degree by thrusting sediment or soil 8 therearound by the reverse rotation of pile member 9 while keeping it under the compression of boom 10 of mobile crane 2, and then propelling pile member 9 further downwards as before by positive rotation. Thus, when pile member 9 is driven into ground 12 to a predetermined depth, in order to more tightly compress ground 12 pile member 9 is rotated in reverse while consolidation material 13 such as sand, crushed stone, etc. is fed from above spiral propelling blade 7 so that consolidation material 13 is compressed tightly around pile member 9 from its lower portion. In this case, when pile member 9 begins to move upwards, its rotation is stopped, and connector 3 is separated from flange 4.

Upon repetition of the above operation, when a number of pile members 9 are driven into ground 12 within the range of reach of boom 10 of mobile crane 2, height adjusting member 18 provided at its bottom with valve means 15 or sand discharge orifice 16 is introduced into height adjustin chamber 14 of pile member 9 formed in its upper portion by the use of boom 10 of mobile crane 2, and when height adjusting member 18 is raised bit by bit by boom 10 after sand 17 is supplied into the inside of height adjusting member 18 through sand supply orifice 23, sand 17 is discharged through valve means 15 or discharge orifice 16 so that the height of base plate 19, i.e. the height of a bridge pier to be constituted by pile members 9 and height adjusting members 18 is adjusted by sand 17 filled within the space formed between the bottom of height adjusting member 18 and partition plate 11 of pile member 9. Thus, after the height of base plates 19 of all of height adjusting members 18 has been adjusted so as to align with each other, bridge girders 20 made of steel in a standardized profile are laid on base plates 19 by a hook mounted to boom 10 at its front end as shown in FIG. 4 to be fixedly secured to base plates 19 by suitable fastening mountings 21 as shown in FIG. 5.

Upon completion of the mounting of bridge girders 20, standardized cover boards 22 are mounted on bridge girders 20 by the use of the same mobile crane 2, and after crane 2 is moved on cover boards 22 thus mounted, the process of driving other pile members 9 into ground 12, etc. is repeated in the same manner as so far described, as shown in FIG. 5 so that a temporary bridge having a predetermined length and width is eventually erected.

Conversely, in order the remove the temporary bridge thus erected, it may be easily done by reversing the process above said, i.e. after cover boards 22 and bridge girders 20 are removed by lifting them with mobile crane 2, height adjusting member 18 is withdrawn from height adjusting chamber 14 of pile member 9. Then, after flange 4 of pile member 9 is connected to prime mover 1 for driving an earthauger through coupler 3, when prime mover 1 is revolved in a reverse direction to that of the driving-in of pile member 9 it is moved upwards due to the propelling action of spiral propelling blade 7 of pile member 9, whereby it is pulled up by crane 2 to be removed from ground 12.

Figure 6:
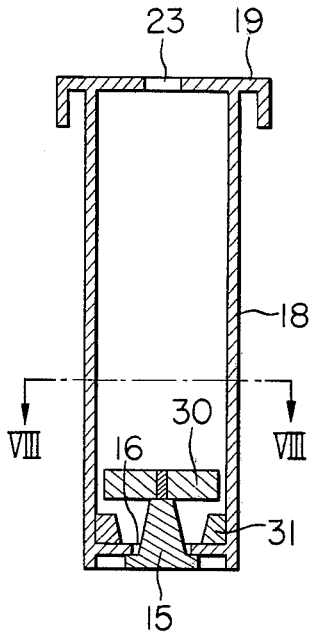
FIG. 6 is a vertical sectional view of one embodiment of a height adjusting member to be used in cooperation with the pile member shown in FIGS. 1 and 2 taken on the line VI—VI of FIG. 7.
Figure 9:
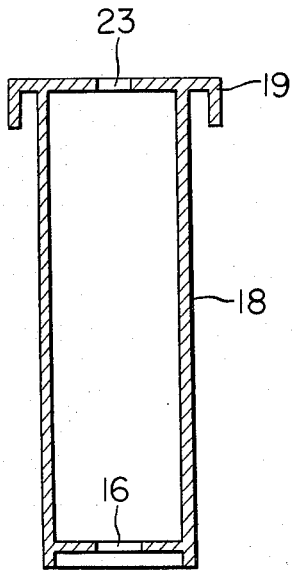
FIG. 9 is a vertical sectional view of another embodiment of a height adjusting member taken along the line IX—IX of FIG. 10.
Figure 7:
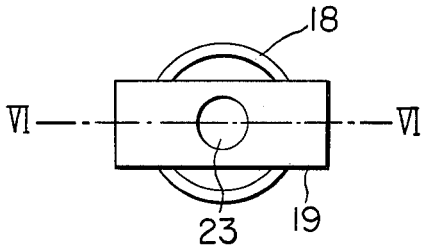
FIG. 7 is a plan view of FIG. 6.
Figure 10:
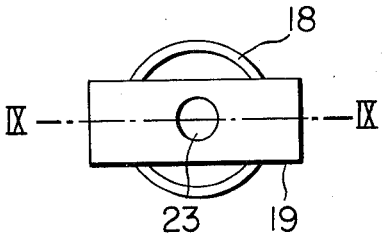
FIG. 10 is a plan view of FIG. 9.
Figure 8:
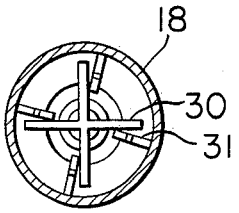
FIG. 8 is a cross-sectional view of the height adjusting member shown in FIGS. 6 and 7 taken along the line VIII—VIII of FIG. 6.

At this point two embodiments of height adjusting member 18 to be used in association with pile member 9 will be somewhat fully explained in reference to FIGS. 6 through 10. As shown in FIGS. 6 to 8, in the first embodiment, height adjusting member 18 made of metal, preferably steel, is provided in the closed bottom with sand discharge orifice 16 centrally thereof and a valve means 15 is provided in discharge orifice 16 so as to abut with the underside surface of the bottom to close discharge orifice 16 with stop element 30 having a generally cross shaped form in plan view being put on abutments 31 correspondingly rigidly disposed on the bottom. When valve means 15 is displaced by any suitable means from the position where the respective arms of stop element 30 confront abutments 31, respectively, it is dropped on to the bottom by its own weight to open discharge orifice 16. The second embodiment shown in FIGS. 9 and 10 is substantially identical to the first embodiment in constitution except that the former lacks the valve means 15 and abutments 31 of the latter. The operation of height adjusting member 18 will be self-evident from the drawings as well as the above explanation so that a more detailed explanation thereof is believed redundant.

From the foregoing it will be appreciated that the method for the erection of a temporary bridge, etc. according to the present invention, which is characterized in the use of hollow cylindrical pile member 9 provided with spiral propelling element 7 in association with height adjusting member 18 and also adapted to be used as a temporary bridge pier, etc. has the following considerable advantages: Since spiral propelling blade 7 provided on the outer periphery of pile member 9 functions not only to drive the pile into the ground, but also to tightly compress the soil around the pile by rotating it in reverse, the pile member can be supported by the ground, in particular by soft ground, with an increased horizontal bearing power together with an increased vertical bearing power. Therefore, the pile means according to the present invention can be driven into the ground regardless of the nature thereof and it can be easily driven even into a gravelly soil.

Further, since the pile member is driven into the ground through the rotation of spiral propelling element 7 formed around its outer periphery, compared with a conventional process wherein a pile is driven into the ground by impact, it is driven in without noise, vibration, etc.

It is another advantage of the present invention that since in the pile member according to the present invention only the area it occupies comes directly into contact with the ground, when the present invention is applied to temporarily erect a road in such as agricultural land, the land is not damaged by the erection work, and restoration is made easy. Further, for example, in the case of driving the pile means into rivers, or the like, no operation for watersealing is required.

Moreover, according to the present invention, since all of the works necessary for the erection of a temporary bridge, etc. can be carried out by the use of a single mobile crane and the work can be proceeded with progressively by successively extending the bridge to any length or width, the temporary erection work can be carried out easily with high efficiency and with the use of a limited quantity of equipment, even on a narrow site.

Although the pile means provided with a spiral propelling element according to the present invention has been described and shown above as being used as a temporary bridge pier, there is, of course, no reason why it should not be used as a permanent bridge pier, etc., if necessary.

It is to be understood that although certain forms of this invention have been illustrted and described, it is not to be limited thereto except so far as such limitations are included in the following claims:

What is claimed is:

1. A pile means for a temporary structure comprising a pile member, a height adjusting member and a supply of sand, said pile member comprising a hollow cylindrical pile body made of metal and having a desired length with its upper and lower end being opened and closed, respectively, a spiral propelling element provided on the outer periphery of said pile body over substantially its entire length, a flange at its upper end adapted to engage a prime mover, and a partition plate provided inside said pile body at its upper portion so as to form a height adjusting chamber above said partition plate to receive said height adjusting member and said supply of sand, and said height adjusting member comprising a hollow cylinder made of metal and having an outer diameter somewhat less than the inner diameter of said pile body as well as a height somewhat higher than the depth of said height adjusting chamber of said pile body, whereby the lower end of said hollow cylinder is closed by a bottom in which a sand discharge orifice is drilled therethrough, while the upper end of said hollow cylinder is provided with a base plate in which a sand supply orifice is drilled therethrough, said bottom being configured to rest upon said supply of sand in said height adjusting chamber to support said height adjusting member at a predetermined height within said height adjusting chamber.

2. A pile means as claimed in claim 1 wherein tip blades are provided on said lower closed end of said pile body outwards thereof.

3. A pile means as claimed in claim 1 wherein said hollow cylinder is provided with a valve means in said bottom to close said sand discharge orifice.

4. A pile means as claimed in claim 2 wherein said hollow cylinder is provided with a valve means in said bottom to close said sand discharge orifice.

* * * * *